US006681539B2

(12) United States Patent
Yost et al.

(10) Patent No.: US 6,681,539 B2
(45) Date of Patent: Jan. 27, 2004

(54) CONCRETE FORM PANELS, CONCRETE WALL AND METHOD OF FORMING

(76) Inventors: Louis L. Yost, 16365 Falls Rd., Monkton, MD (US) 21111; William R. Yost, 16365 Falls Rd., Monkton, MD (US) 21111

( * ) Notice: Subject to any disclaimer, the term of this patent is extended or adjusted under 35 U.S.C. 154(b) by 110 days.

(21) Appl. No.: 10/050,069

(22) Filed: Oct. 24, 2001

(65) Prior Publication Data

US 2002/0178676 A1 Dec. 5, 2002

Related U.S. Application Data

(63) Continuation-in-part of application No. 09/850,997, filed on May 8, 2001, which is a continuation-in-part of application No. 09/580,247, filed on May 26, 2000, now Pat. No. 6,240,692.

(51) Int. Cl.[7] ..... E04B 1/18

(52) U.S. Cl. ..... 52/309.11; 52/426; 52/742.14

(58) Field of Search ..... 52/309.11, 426, 52/309.12, 742.14; 249/190, 213, 40, 41

(56) References Cited

U.S. PATENT DOCUMENTS

| | | | | |
|---|---|---|---|---|
| 1,924,631 A | * | 8/1933 | Toogood | 249/215 |
| 2,161,379 A | * | 6/1939 | Neptune | 249/190 |
| 2,656,581 A | * | 10/1953 | Gates | 249/214 |
| 2,859,503 A | * | 11/1958 | Hennig | 249/191 |
| 4,669,234 A | * | 6/1987 | Wilnau | 52/98 |
| 5,040,344 A | * | 8/1991 | Durand | 52/127.2 |
| 5,570,552 A | | 11/1996 | Nehring | |
| 5,809,728 A | | 9/1998 | Tremelling | |
| 5,845,448 A | | 12/1998 | Potvin | |
| 5,887,401 A | | 3/1999 | Moore, Jr. | |
| 5,895,188 A | * | 4/1999 | Cheng | 411/433 |
| 6,240,692 B1 | | 6/2001 | Yost et al. | |

FOREIGN PATENT DOCUMENTS

| | | |
|---|---|---|
| BE | 541742 | 10/1955 |
| SE | 175441 | 3/1961 |

* cited by examiner

*Primary Examiner*—Carl D. Friedman
*Assistant Examiner*—Basil Katcheves
(74) *Attorney, Agent, or Firm*—Armstrong, Kratz, Quintos, Hanson & Brooks, LLP

(57) ABSTRACT

A concrete form assembly has at least two opposed insulation panels. A plurality of vertical studs are formed on the outer face of each panel. The panels are connected by a plurality of bridges and retaining clips are disposed on the ends of each of the bridges against the studs on each panel. Concrete is received between the panels. Several embodiments of bridges and of retaining clips are disclosed. A concrete wall having at least one panel attached is disclosed. A method of forming the concrete wall is disclosed.

27 Claims, 10 Drawing Sheets

CONCRETE FORM PANELS, CONCRETE WALL AND METHOD OF FORMING

CROSS REFERENCE TO RELATED APPLICATIONS

The present application is a continuation-in-part of U.S. application Ser. No. 09/850,997, filed May 8, 2001 which is a continuation-in-part of Ser. No. 09/580,247 filed May 26, 2000 now U.S. Pat. No. 6,240,692 B1, both of which are incorporated in their entirety by reference hereto.

FIELD OF THE INVENTION

The present invention is directed to a concrete form assembly of panels which are spaced apart to form walls into which concrete is poured for construction purposes and to the wall formed thereby. More particularly, the present invention is directed to the panels and to means of assembling the panels to form a wall.

BACKGROUND OF THE INVENTION

It is known that insulated polystyrene panels may be joined together to form walls which are interconnected with bridges so that two parallel walls are formed into which concrete may be poured for construction purposes.

The applicant is aware of the following patents which are directed to walls of structures which are formed from concrete and block and have cross supporting structure.

| U.S. Pat. No. | Inventor(s) |
|---|---|
| 5,570,552 | Nehring |
| 5,809,728 | Tremeling |
| 5,845,488 | Potvin |
| 5,887,401 | Moore, Jr. |
| 6,240,692 | Yost et al |
| **Foreign Patent No.** | **Country** |
| 541742 | Belgium |
| 175441 | Sweden |

None of these patents disclose an insulated panel having vertical studs on the outer face of the panel with bridge means extending through the panel over a predetermined space to an opposite panel.

BRIEF SUMMARY OF THE INVENTION

An object of the present invention is to provide a concrete form assembly which is more economical to produce and provides greater structural support than existing assemblies.

A further object of the present invention is to provide a concrete form assembly which is easily and rapidly used in construction sites.

Another object is to provide an assembly in which the insulation panel may be removed after the concrete has set.

In accordance with the teachings of the present invention, there is disclosed a concrete form assembly for construction of structures. The assembly has at least a first and a second rectangular insulation panel. Each panel has an inner face and an outer face. The panels are disposed such that the inner faces of the respective panels are oriented toward one another. A plurality of studs are vertically disposed on the outer face of the first panel, the studs being equidistantly spaced apart. A plurality of vertically spaced-apart openings are formed in each stud. A plurality of bridge means are provided, each bridge means having a first end, an opposite second end and a length therebetween. A connecting means is formed on each first end and an engaging means is formed on each second end. Each bridge means is received in a respective one of the openings in each stud with the connecting means on the first end being exteriorly of the stud. The bridge means extends through the first panel and the engaging means on the second end is connected to the second panel. The bridge means is disposed across a desired space between the first panel and the second panel. Concrete is received in the space between the panels.

In further accordance with the teachings of the present invention, there is disclosed a concrete form assembly for construction of structures. The assembly has at least a first and a second rectangular insulation panel. Each panel has respectively a top, a bottom, a first side, an opposite second side, an inner face and an outer face. The panels are disposed adjacent to one another wherein the inner faces of the respective panels are oriented toward one another. A plurality of studs are vertically disposed on the outer face of each panel, the studs being equidistantly spaced apart. A plurality of vertically spaced-apart openings are formed in each stud. A plurality of loop bridges are provided. Each loop bridge is disposed in a respective one of the openings in each stud in the first panel and extends through the corresponding opening in the second panel. Each loop bridge has a first end, an opposite second end and a length therebetween. A loop is formed on each of the first end and the second end. The loop bridge extends through the first panel across a desired space and through the second panel. A plurality of retainer means are provided. Each end of each loop bridge receives a respective retainer means thereon wherein the panels are secured in the desired spaced-apart distance to receive concrete therebetween. Concrete is received in the space between the panels.

In still further accordance with the teachings of the present invention, there is disclosed a concrete form assembly for construction of structures. The assembly has at least a first and a second rectangular insulation panel. Each panel has respectively a top, a bottom, a first side, an opposite second side, an inner face and an outer face. The panels are disposed adjacent to one another wherein the inner faces of the respective panels are oriented toward one another. A plurality of studs are vertically disposed on the outer face of the first panel, the studs being equidistantly spaced apart. A plurality of vertically spaced-apart pairs of openings are formed in each stud, one opening of each pair having a greater length than the length of the second opening of said pair. A plurality of bridge clips are provided. Each bridge clip has a substantially U-shape with a base and a first and a second parallel leg. The first leg has a greater width than the second leg. Each leg has at least one barb formed thereon. Each leg further has an aperture formed therein distal from the base of the bridge clip. Each bridge clip is disposed in a respective pair of openings in a respective stud, the first wider leg being received in the opening with the greater length and the second leg being received in the second opening. The distal ends of each leg has the openings therein extending beyond the inner face of the insulation panel. The barbs on the legs engage the insulated panel and prevent removal of the bridge clip. A U-shaped wire bridge has an arm at opposite ends thereof. One arm of the wire bridge is received in the apertures in the distal ends of the legs of the bridge clip. The other arm of the wire bridge is connected to the second panel, wherein the panels are spaced apart by the wire bridge. Concrete is received in the space between the panels.

In another aspect, there is disclosed a concrete wall for construction of structures. The wall has at least a first and a second rectangular insulation panel. Each panel has an inner face and an outer face. The panels are disposed such that the inner faces of the respective panels are oriented toward one another. A plurality of studs are vertically disposed on the outer faces of each of the panels, the studs being equidistantly spaced apart. A plurality of vertically spaced-apart openings are formed in each stud. A plurality of bridge means are provided. Each bridge means has a first end, an opposite second end and a length therebetween. The first end of each bridge means is received in a respective opening in the studs in the first panel. The second end of each bridge means is received in a respective opening in the studs in the second panel. The bridge means are disposed across a desired space between the first panel and the second panel. A plurality of retainer means are provided. Each end of each bridge means receives a respective retainer means thereon wherein the panels are secured in the desired spaced-apart disposition. The concrete wall is disposed between the panels, the bridge means serving as reinforcing means for the concrete.

In yet another aspect, there is disclosed a concrete wall for construction of structures. The wall has a plurality of rectangular insulation panels, each having a top, a bottom, a first side, a second side, an inner face and an outer face. The panels are interconnected forming a wall. A plurality of studs are vertically disposed on the outer face of each of the panels, the studs being equidistantly spaced. A plurality of bridge means are disposed in each stud in each panel and extend approximately perpendicularly from the inner face of each panel. The concrete wall is connected to the panel by the bridge means which serve as reinforcing means for the concrete.

In still a further aspect of the present invention, there is disclosed a method of constructing a concrete wall. At least a first and a second rectangular insulation panel are provided. Each panel has an inner face and an outer face. The panels are disposed such that the inner faces of the respective panels are oriented toward one another. A plurality of studs are disposed vertically on the outer faces of both panels, the studs being equidistantly spaced apart. Each stud has a plurality of vertically spaced-apart openings formed therein. A plurality of bridge means are provided, each having a first end, a second end and a length therebetween. A connecting means is formed on each first end and an engaging means is formed on each second end. Each bridge means is disposed in a selected one of the openings in the stud in the first panel wherein the connecting means on the first end is exterior of the stud on the outer face of the first panel. The bridge means extends through the first panel across a desired space between the first panel and the second panel and engages the second panel providing a plurality of retaining means. A plurality of retaining means are provided. A respective one of the retaining means is disposed on each loop extending from the outer face of the first panel. Concrete is introduced in the space between the panels and the concrete is allowed to set.

These and other objects of the present invention will become apparent from a reading of the following specification taken in conjunction with the enclosed drawings.

DESCRIPTION OF THE PREFERRED EMBODIMENTS

Figures 1, 2, 3:
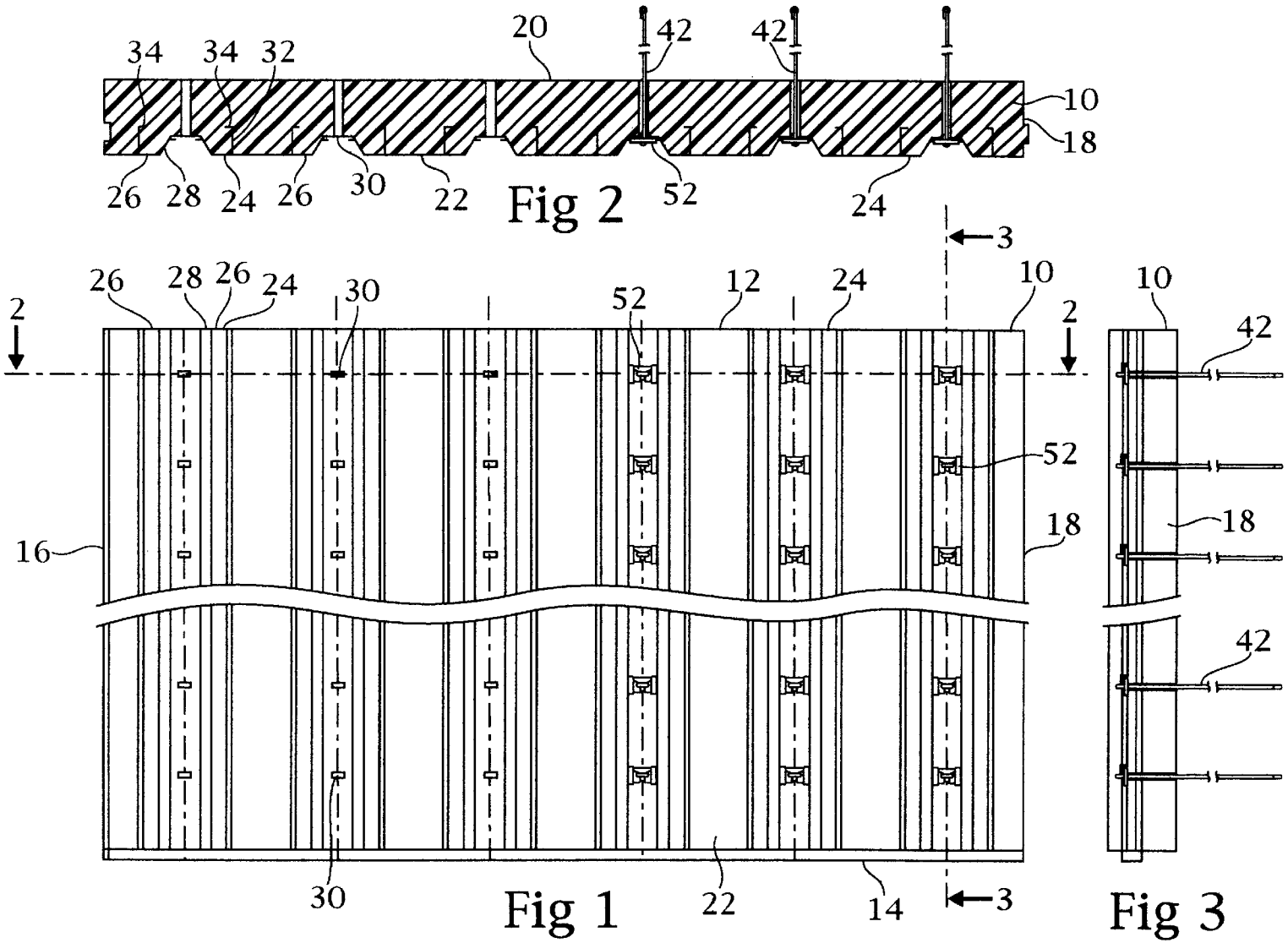
FIG. 1 is a front plan view of the present invention showing a panel with a plurality of studs and retainer clip means in some of the openings.
FIG. 2 is a cross-sectional view taken across the lines 2—2 of FIG. 1 further showing the loop bridges.
FIG. 3 is a cross-sectional view taken across the lines 3—3 of FIG. 1 further showing the loop bridges.

Referring now to FIGS. 1–3, an insulated panel 10 is substantially rectangular having a top 12, a bottom 14, a first side 16, an opposite second side 18, an inner face 20 and an outer face 22. The sides 16, 18, top 12 and bottom 14 have tongues and grooves formed therein as disclosed in U.S. Pat. No. 6,240,692 B1. In this manner, a plurality of panels 10 may be joined top and bottom and side to side to form a wall of desired dimensions. Preferably, each panel is 20 inches in height, 48 inches in length and 2½ inches in thickness. However, these dimensions may be changed as needed. Each panel is a molded plastic preferably formed from flame retardant expanded polystyrene.

A plurality of studs 24 are vertically disposed on the outer face 22 of each panel 10. The studs 24 are equidistantly spaced apart. The spacing may be 8 inches, 12 inches or 16 inches on center as commonly used in the construction industry or may be of any other desired spacing. Preferably, the stud is made of sheet metal of a desired thickness although the stud may be made of a rigid and sturdy plastic. Construction of metal is more economical because of the material cost and the manufacturing costs. Manufacturing costs for plastic include expensive molds, expensive molding equipment and high energy. Metal studs may be roll formed or extruded to a desired shape. The studs may be formed close to or immediately below the surface of the panel 10. It is preferred that each stud 24 have a length from the top 12 to the bottom 14 of the panel 10 to which it is attached.

Preferably, the studs 24 each have two outer columns 26 with a center column 28 therebetween. The center column 28 preferably is recessed with respect to the outer columns 26. The recess is formed within the outer face 22 of the panel. The recess may be in the shape of a triangle, rectangle, trapezoid, semi-circle, other arcuate shape or there may be a plurality of aligned depressions formed between the outer columns 26. A depressed center column is not essential.

A plurality of vertically spaced-apart bridge access openings 30 are formed in each stud 24. Preferably, the bridge access openings 30 are formed in the center columns 28 at approximately the mid center line of the respective stud 24. Each bridge access opening 30 is preferably a horizontal slot having a predetermined length.

Figure 6:
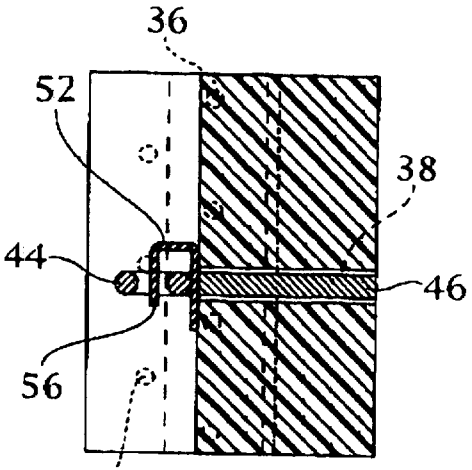
FIG. 6 is a cross-sectional view taken across the lines 6—6 of FIG. 4.
Figure 4:
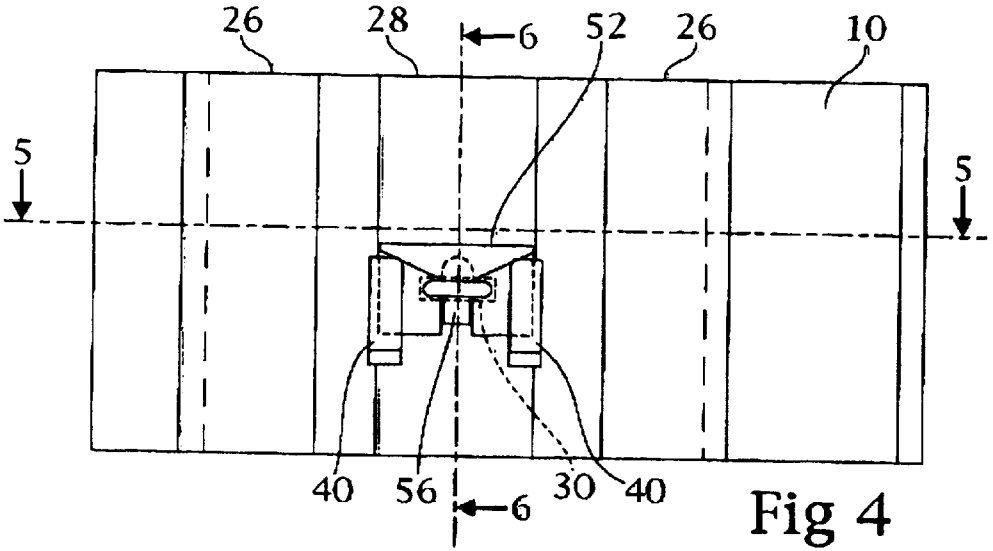
FIG. 4 is an enlarged front plan view of a portion of an assembly showing one retainer clip and one loop bridge.
Figure 5:
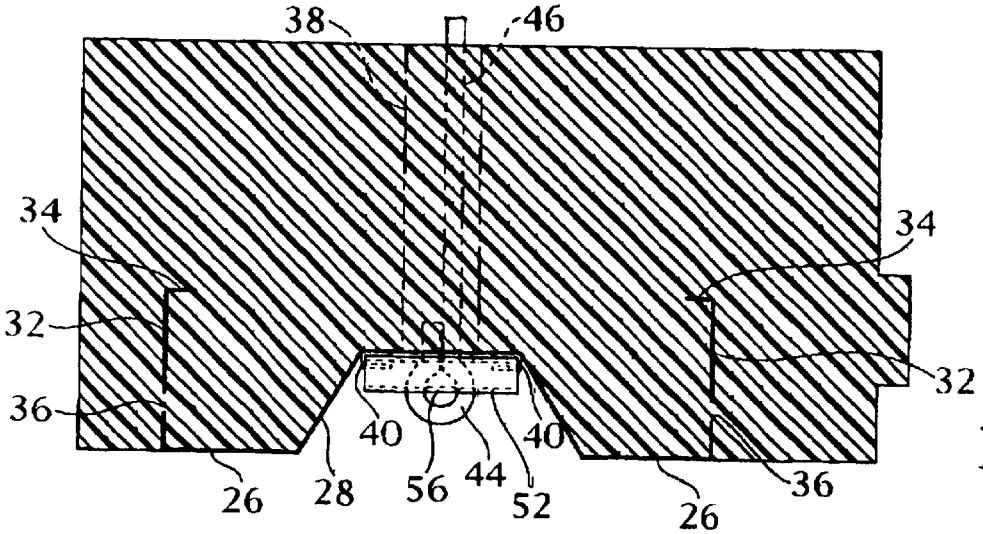
FIG. 5 is a cross-sectional view taken across the lines 5—5 of FIG. 4.

Each outer column 26 further has an extension leg 32 formed thereon such that a first extension leg 32 is formed on the first outer column 26 and a second extension leg 32 is formed on the opposite second outer column 26 (FIGS. 4–6). Each extension leg 32 is approximately perpendicular to the outer column 26 of the stud 24 and extends into the panel 10. A stud locking extension 34 is formed on each of the first and second extension legs 32 distal from the stud. Each stud locking extensions 34 is approximately perpendicular to the respective extension leg 32. The stud locking extension 34 may be oriented toward or away from the center column. The extension legs 32 and the stud locking extensions 34 assist in retaining the stud 24 in the panel.

It is further preferred that a plurality of spaced-apart perforations 36 be formed in each extension leg 32. Thus, when the panel 10 is formed, the studs 24 are in place and the polystyrene flows through the perforations 36 and sets up to secure the stud 24 and prevent movement of the stud 24 with respect to the panel 10.

When the panel 10 is formed, it is preferred that a plurality of transverse passages 38 be formed in the panel extending between the inner face 20 and the outer face 22 of the panel 10. These transverse passages 38 are aligned with the plurality of openings 30 formed in each of the studs 24 as will be described.

On opposite sides of each transverse slot 38 in each panel 10 there is formed a key keeper 40. Each key keeper 40 has a vertically aligned portion parallel to the stud 24. Each portion is connected to the stud 24 by a short leg which is substantially perpendicular to the portion and is distal from the transverse slot 38. In this manner, the two key keepers 40 are on opposite sides of the transverse slot 38 and do not obstruct access to the bridge access opening 30 and the transverse slot 38.

Figure 7:
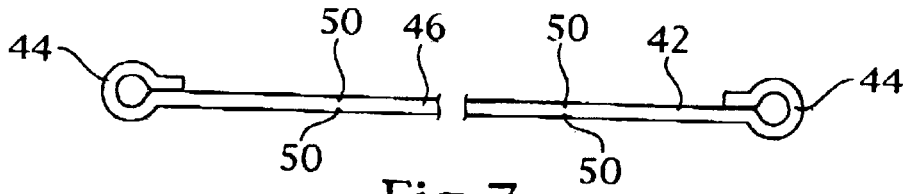
FIG. 7 is a top plan view of a loop bridge formed from wire.
Figure 8:
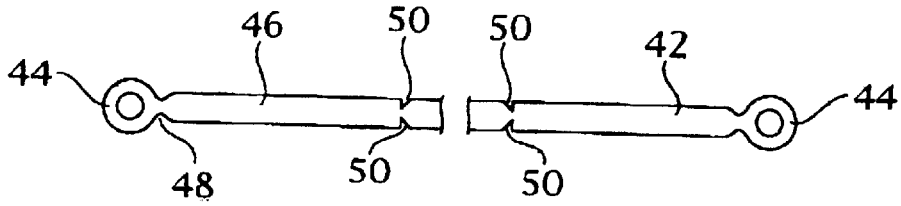
FIG. 8 is a top plan view of a loop bridge formed from a sheet of material.

A plurality of bridge means are provided. As shown in FIGS. 7 and 8 a loop bridge 42 has a loop 44 formed at opposite ends. The bridge means has a body 46 between the loops 44. One of the bridge means is disposed in a respective opening 30 in the stud 24 and through the transverse passage 38 in the panel 10. The length of the body 46 preferably extends through the first panel 10 across a space between the panels of a desired length and through the second panel 10, as will be described, for concrete to be received between the panels 10. The loop bridge 42 (FIG. 7) is formed from wire having a desired diameter. Alternately, the loop bridge 42 (FIG. 8) is formed from a flat stamped piece of a rigid material such as metal having a desired thickness. Adjacent to the loop 44 is a constriction 48. Also, at a predetermined distance from each loop 44, there is formed a pair of opposed notches 50 so that each loop bridge 42 has four (4) notches 50 formed therein. The purposes for the constriction 48 and the notches 50 will be described. The loop bridge 42 may have only one loop 44 and a downwardly depending arm at the opposite end of the loop bridge 42. This type of loop bridge may be used to connect with a plastic stud panel of U.S. Pat. No. 6,240,092. Alternately, the bridge means may be U-shaped bridge with arms or downwardly dependent members at opposite ends. The bridge means may have any type of engaging means or connecting means at opposite ends so that the bridge means be connected to the opposite panels by engaging or connecting means formed on the panels. In the following description, the bridge will be described as a loop bridge for illustration purposes, recognizing that other types of bridges may be used consistent with the structure of other components as will be described. The loop may be considered to be a connecting means.

A retainer means is connected to the bridge means. The retainer means and the bridge means may be one of several embodiments.

Figure 9:
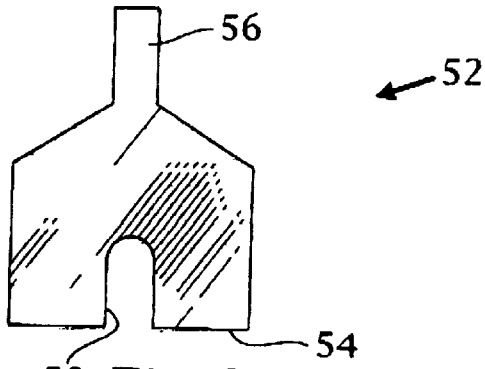
FIG. 9 is an enlarged top plan view of a loop bridge locking key.
Figure 10:
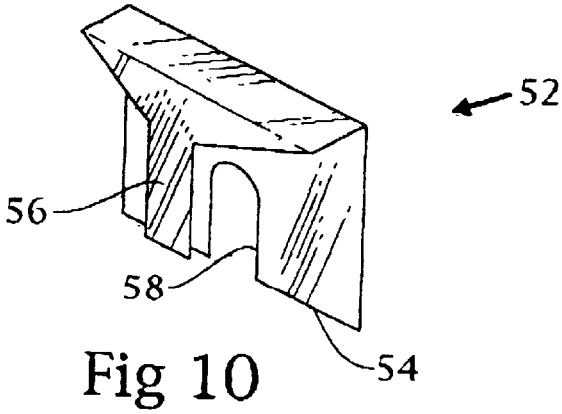
FIG. 10 is a perspective view of the bent loop bridge locking key of FIG. 7.
Figure 11:
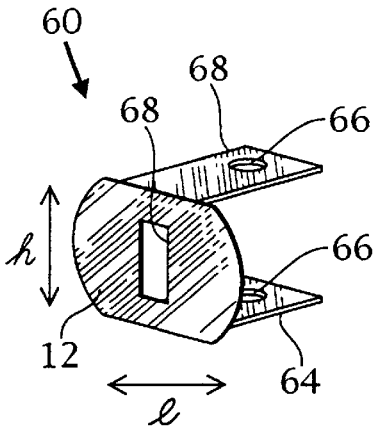
FIG. 11 is a perspective view of the rotating retainer.
Figure 12:
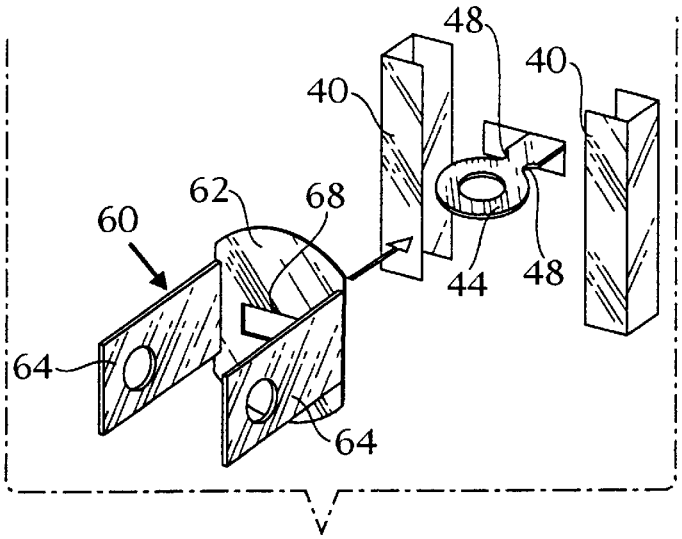
FIG. 12 is a perspective view of the rotating retainer of FIG. 11 being disposed on the loop bridge.
Figure 13:
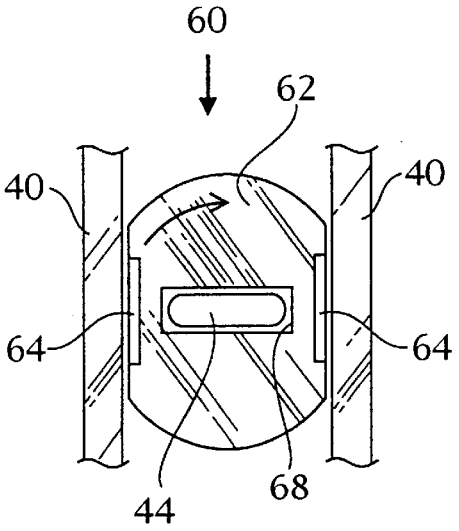
FIG. 13 is a front plan view showing the rotating retainer of FIG. 11 being rotated through 90°.
Figure 14:
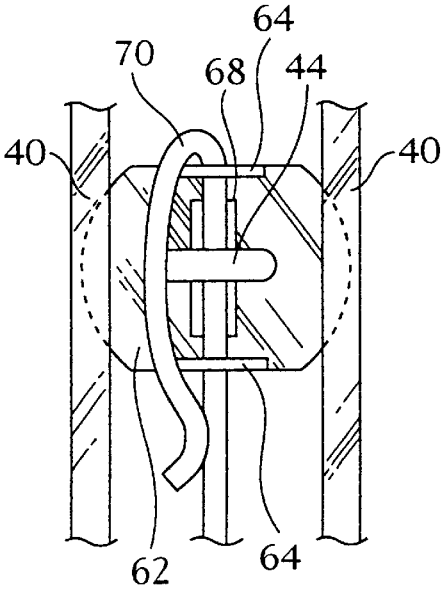
FIG. 14 is a front plan view showing a spring key disposed in the rotating retainer of FIG. 11.

One embodiment of the retainer means is shown in FIGS. 9 and 10. This embodiment is a locking key 52. The locking key 52 has a wider base 54 which tapers to a narrower locking extension 56. A locking slot 58 is formed at the approximate midpoint of the base 54 extending toward the locking extension 56. The locking key 52 is bent through approximately 180° such that the locking extension 56 is approximately aligned with, and spaced apart from, the locking slot 58. The locking key 52 is placed over the loop bridge 42 such that the locking slot 58 straddles the constriction 48. In the wire embodiment of FIG. 7, the return portion of the loop 44 and the wire is received in the locking slot 58. In the flat embodiment of FIG. 8, the constriction 48 is received in the locking slot 58. The wider base 54 of the locking key 52 is disposed between the key keepers 40 and the stud 24. The locking extension 56 of the locking key 58 is received in the loop 44. In this manner, the locking key 52 secures the stud 24 (and the panel 10 attached thereto) to the bridge means such that there is no significant movement possible between the bridge means and the studs 24. The locking key 52 is not a friction fit with the key keepers 40 so that there is slack space to allow for tolerances in the dimensions of the components. This embodiment is designed for use with walls which have a space of no greater than 5½ inches between panels into which concrete is received. If used with thicker walls, there is a possibility that pressure created by the concrete could deform the locking slot 58 and bend the locking extension 56. After the concrete has been poured and allowed to set, it is possible to remove the plurality of locking keys 52 and remove the panel 10 from the concrete.

In each of the above embodiments, the retaining means are removably connected to the panels 10 and the studs 24. Thus, after the concrete has been poured and allowed to set, the retaining means may be removed and the panel 10, which was in place to form the wall, may be removed. The panel may be either the exterior or the interior panel (or both). If a panel is to be removed, it is preferred that the exterior panel be removable so that the exterior concrete wall may be uncovered. In this way, the concrete wall may be painted, covered with stucco or a brick facing may be constructed. The panel on the interior wall usually is not removed because the insulated panel assists in the thermal stability of the building which is to be constructed. Plumbing and electrical connections can be mounted inside the insulated panel by cutting a channel in the panel to receive the plumbing and electrical connections. Dry wall or other construction may be used interiorly.

Another embodiment of the retaining means is the rotating retainer 60 shown in FIGS. 11–14. The rotating retainer 60 has a base 62 with a pair of parallel legs 64 on opposite sides of the base 62. Each leg 64 has a through opening 66 formed therein distal from the base 62. A slot 68 is formed in the base 62 between the legs 64. The height (h) of the base 62 between the legs 64 along the center line of the slot 68 is less than the length (l) of the base 62 perpendicular to the center line of the slot 68. The rotating retainer 60 is disposed on the loop bridge 42 such that the loop 44 is received in the slot 68 in the base 62. The rotating retainer 60 is rotated through 90°. The through openings 66 in the legs 64 are aligned with the loop 44 of the loop bridge 42. The base 62 of the rotating retainer 60 along its length (l) engages the key keepers 40 formed on either side of the openings 30 in the stud 24. The rotating retainer 60 thereby secured to the stud 24. A spring key 70 is inserted into the through openings 66 in the legs 64 and through the loop 44 in the loop bridge 42. Preferably, the spring key 70 is resilient. Thus, the panel 10 is secured to the plurality of loop bridges 42 by the plurality of rotating retainers 60 and plurality of spring keys 70.

The rotating retainer may be formed of plastic or metal. It provides increased surface area contact between the base 62 of the retaining means and the stud 24. This increased surface area enables this embodiment of the retaining clip to withstand greater pressure created from pouring of the concrete into the space between two panels 10. This retaining means is suggested for use when the space between the panels 10 into which concrete is received is greater than 5½ inches. The through openings 66 in the legs 64 are very near the base 62 of the rotating retainer 60 such that when the spring key 70 is inserted into the rotating retainer, there is very little movement between the rotating retainer 60 and the loop bridge 42.

Figure 16:
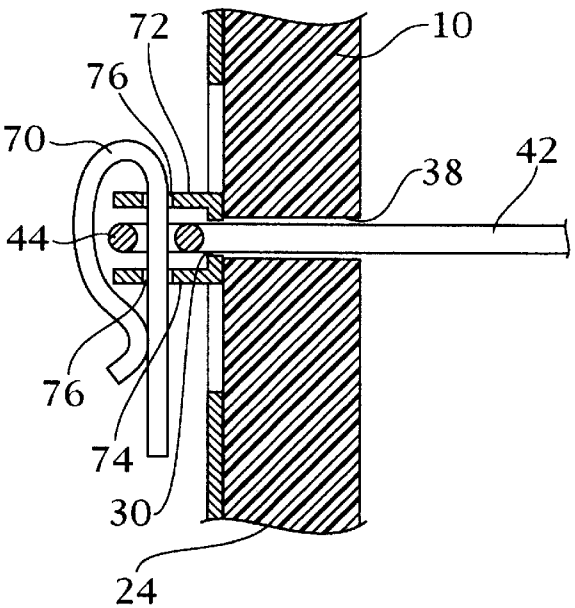
FIG. 16 is a cross-sectional view taken across the lines 16—16 of FIG. 15 and further showing a spring key disposed in the tabs.
Figure 15:
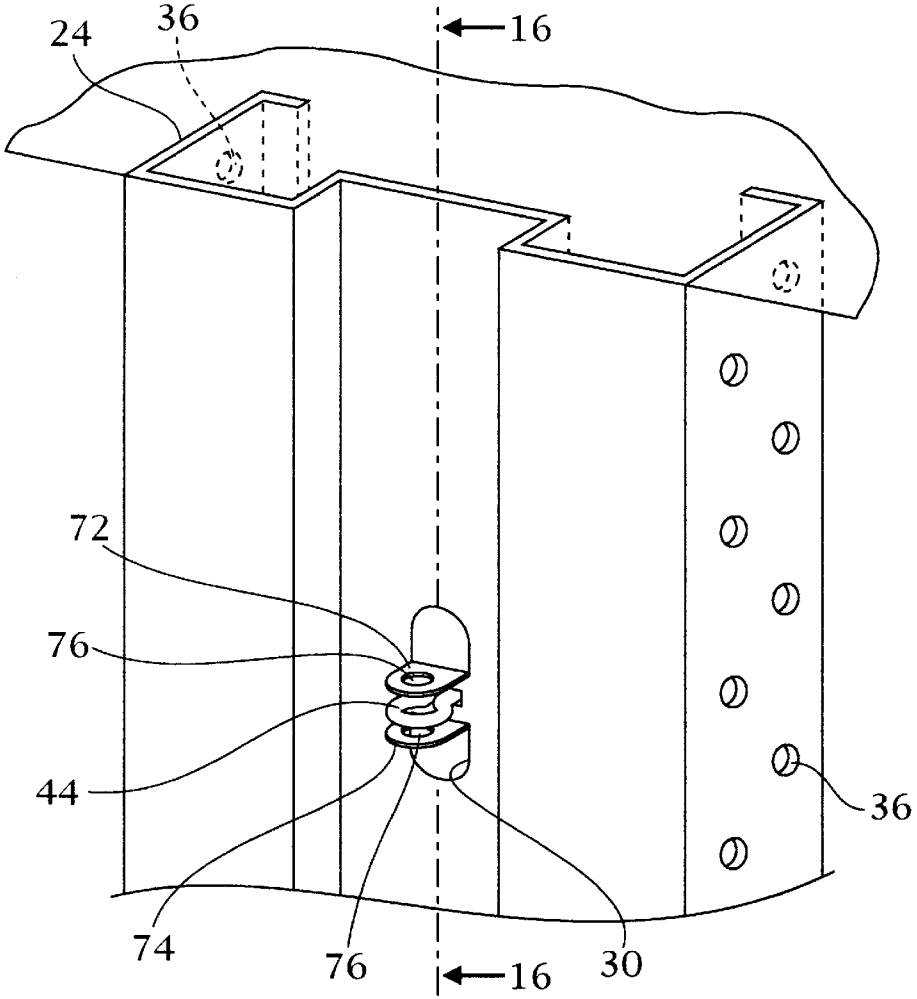
FIG. 15 is a perspective view of the retainer tab.

As shown in FIGS. 15–16, the retainer means are tab legs formed in each stud 24. Each stud 24 has a first lanced out portion 72 above each opening 30 and a second lanced out portion 74 below each opening 30. The lanced out portions 72, 74 are folded through approximately 90° outwardly from the stud 24. The lanced out portions 72, 74 are approximately parallel to one another and are also approximately parallel to the loop 44 on the loop bridge 42 which is disposed in the opening 30. A hole 76 is formed in each of the first lanced out portion 72 and the second lanced out portion 74. The holes 76 are aligned with each other and with the loop 44 in the loop bridge 42. Each of the aligned holes 76 and loops 44 has a respective spring key 70 disposed therein such that the panels 10 are secured to each of the loop bridges 42. Preferably, the spring key 70 is resilient.

Figure 17:
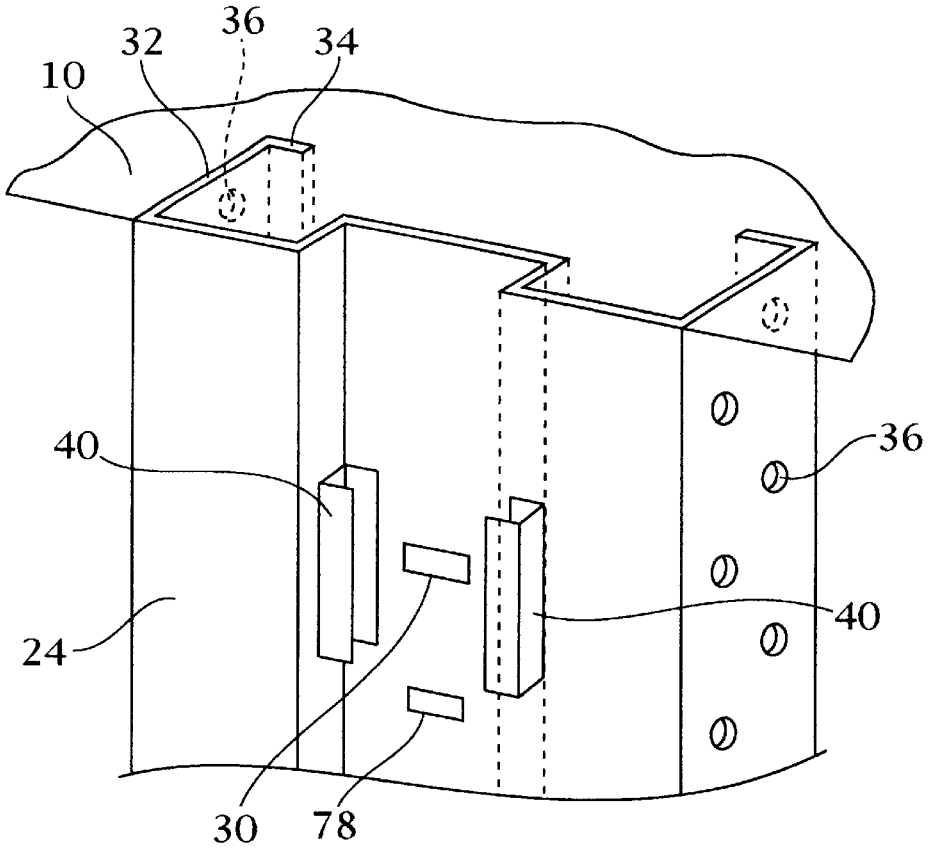
FIG. 17 is a perspective view showing the stud having two adjacent slots.
Figure 18:
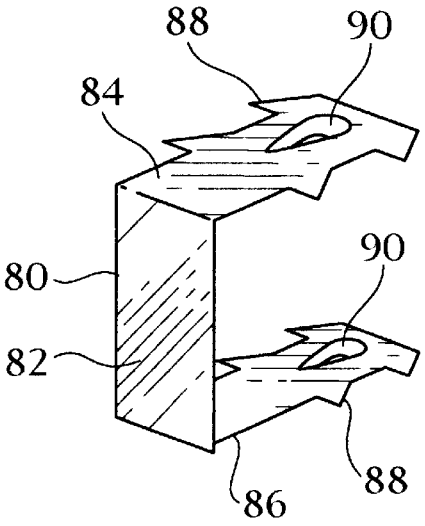
FIG. 18 is a perspective view showing a bridge clip.
Figure 19:
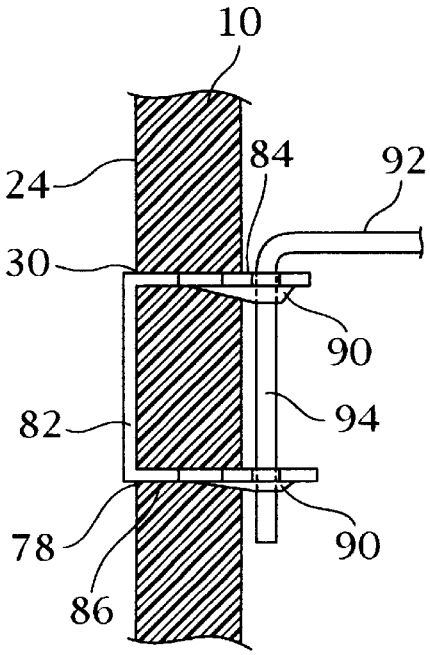
FIG. 19 is a cross-sectional view showing the bridge clip disposed in the panel and a bridge connected to the bridge clip.

In still another embodiment as shown in FIGS. 17–19 a second opening 78 is formed in each stud below the previously described opening 30. Each opening has a respective length and it is preferred that the upper opening 30 be longer than the lower opening 78. A plurality of bridge clips 80 are provided. Each bridge clip 80 is substantially U-shaped having a base 82, a first leg 84 and a second leg 86, the legs being approximately perpendicular to the base 82 and parallel to each other. The first leg 84 has a width greater than the width of the second leg 86. Each leg 84, 86 has at least one respective barb 88 formed thereon. Each leg 84, 86 has a respective aperture 90 formed therein distal from the base 82 of the bridge clip 80.

Each bridge clip 80 is disposed in a respective pair of openings 30, 78 in a respective stud 24. The first wider leg 84 is received in the opening 30 with the longer length and the second narrower leg 86 being received in the second shorter opening 78. The bridge clip 80 is pushed through the panel 10 such that the apertures 90 in the distal portion of legs 84, 86 extend beyond the inner face of the panel 10 and the base 82 of the bridge clip 80 is butted against the stud 24. The barbs 88 on the legs 84, 86 engage the insulated panel 10 and prevent removal of the bridge clip 80.

A U-shaped wire bridge 92 has an arm 94 at each end thereof, the arms 94 preferably being at approximately a 90° angle to the wire bridge 92. One of the arms 94 is received in the apertures 90 in the first leg 84 and the second leg 86 of the base clip 80. Preferably, the apertures 90 are spoon-shaped so that the arm 94 on the wire bridge 92 is more easily directed into the aperture 90. It is also preferred that the second (lower) leg 86 be slightly longer than the first (upper) leg 84. This misaligns the aperture 90 in the first leg 84 from the aperture 90 in the second leg 86. Thus, when the arm 94 of the wire bridge 92 is inserted into apertures 90, the second (lower) leg 84 is bent in a direction away from the first leg 84 to align the apertures 90. When the arm 94 enters the aperture 90 of the second leg 86, the second leg 86 tends to return to its previous unbent position and thereby exerts pressure and captures the arm 94 to create a locking means.

FIGS. 20–29 show the method of forming a wall using insulated panels having studs, bridge means and retaining clips according to the present invention.

Figure 20:
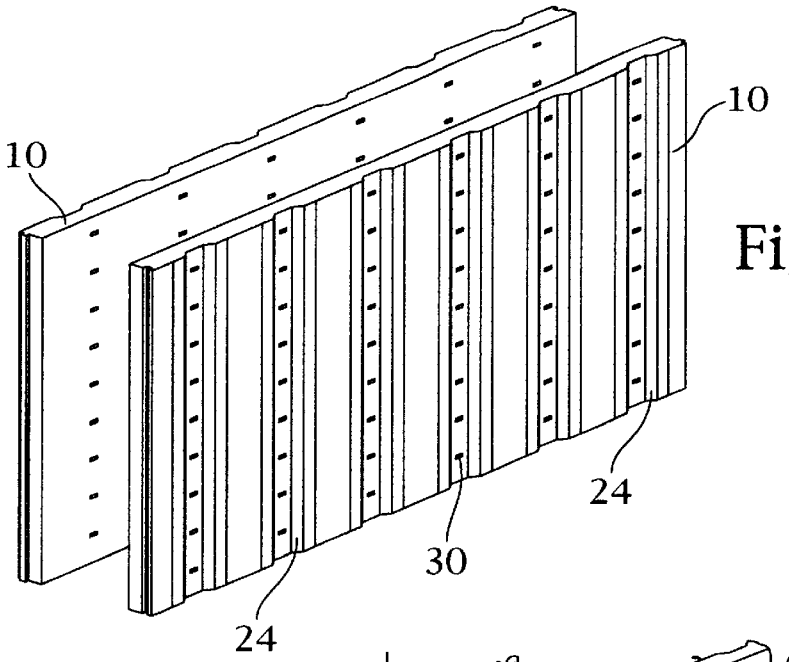
FIG. 20 is a perspective view showing two facing panels.
Figure 21:
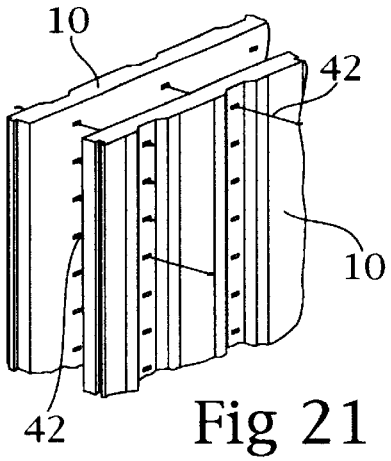
FIG. 21 is a perspective view showing bridges being placed in the panels.
Figure 22:
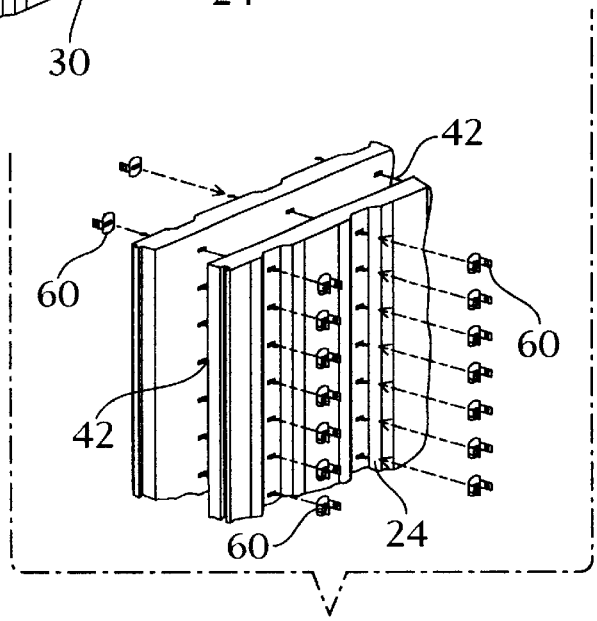
FIG. 22 is a perspective view showing retaining clips being placed on the ends of the bridges.
Figure 23:
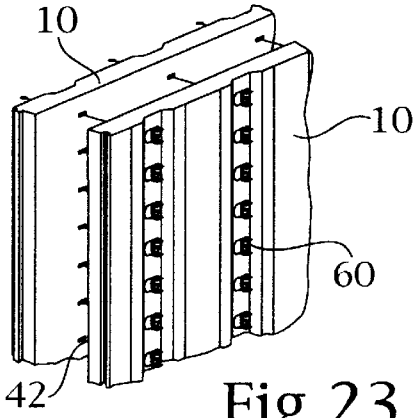
FIG. 23 is a perspective view showing retaining clips secured against the respective studs.
Figure 24:
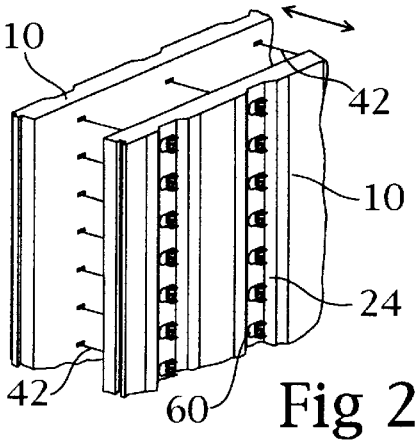
FIG. 24 is a perspective view showing the panels moved apart.
Figure 25:
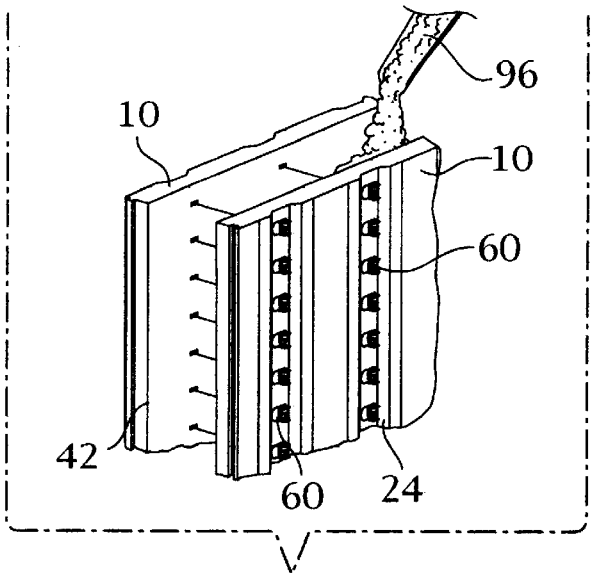
FIG. 25 is a perspective view showing the introduction of concrete into the space between the panels.

Two panels 10 having a plurality of spaced-apart studs 24 on the outer faces of the panels are disposed with the inner faces of the respective panels oriented toward one another (FIG. 20). A plurality of bridge means 42 are disposed in openings 30 in the plurality of studs 24 such that the bridge means extend through both opposing panels 10 (FIG. 21). A respective retaining clip 60 is disposed on each bridge means exteriorly of each panel 10 (FIG. 22). Each respective retaining clip is secured against the respective stud (FIG. 23). The panels 10 are spaced apart a distance dependent upon the length of the bridge means as shown by the arrow in FIG. 24. Concrete 96 is poured into the space between the panels 10. The bridge means serve as reinforcing members for the concrete (FIG. 25) as the concrete sets. If desired, the wall formed with panels on both sides thereof may be used as described.

The wall as shown in FIGS. 20–25 may be formed using any of the embodiments described herein. For convenience of description, the figures show the loop bridge 44 as the bridge means and the rotating retainer 60 as the retaining clip. However, other bridge means and other retaining clips may be used. The present invention is not limited to the members shown in FIGS. 20–25.

Figure 26:
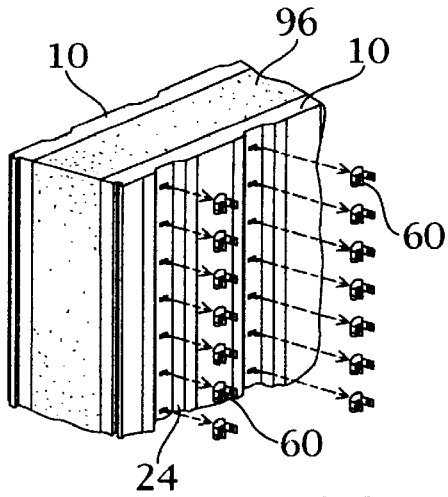
FIG. 26 is a perspective view showing removal of the retaining clips from one of the panels.
Figure 27:
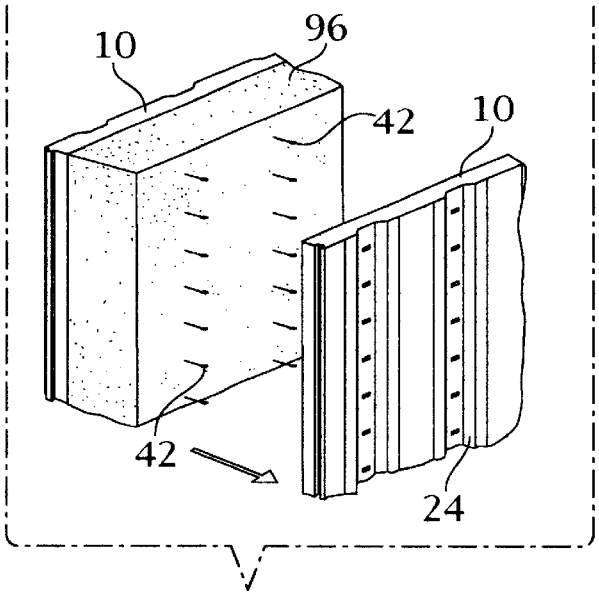
FIG. 27 is a perspective view showing the panel removed from the concrete.
Figure 28:
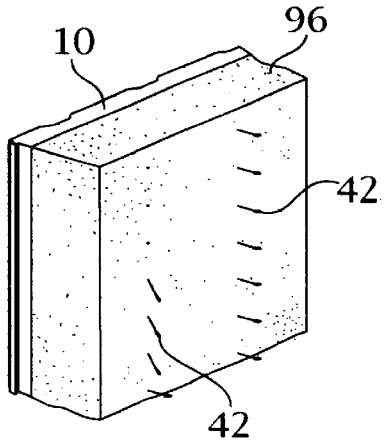
FIG. 28 is a perspective view showing the extending bridges being broken off.
Figure 29:
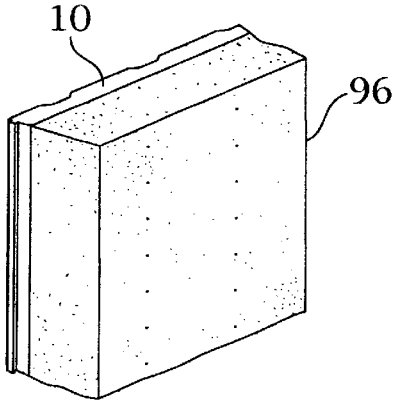
FIG. 29 is a perspective view showing the concrete wall having a panel on one side.

Alternately, the retaining means are removable clips as described previously. FIG. 26 shows, after the concrete has set, the removal of the removable embodiment of the retaining means. The panel 10 is then removed from the plurality of bridge means which extend outwardly from the concrete wall (FIG. 27). As shown in FIG. 28, it is preferred that the extending bridge means be broken off. This is facilitated by the notches 50 in each bridge means which was previously described. When the panels are assembled, the notches 50 are disposed within the space between the panels into which the concrete is received. The notches are very close to the panels so that when the concrete sets, the notches are almost at the interface between the concrete and the inner face of the respective panels. Angular or rotational movement of the outwardly extending bridge means breaks the bridge means at the notches at approximately the surface of the concrete. As shown in FIG. 29, a wall is formed having an insulated panel on one face and a concrete surface on the opposite face. The insulated panel would generally be retained interiorly of the wall to provide thermal insulation. Electrical and plumbing components may be disposed within channels in the panel on the interior of the construction and dry wall or other walling may be mounted over the panel. The concrete surface may be painted, covered with stucco or provided with a brick facing if desired. The panels which are removed may be reused.

Although FIGS. 20–29 show only two opposed panels for ease of illustration. In actual use a plurality of interconnected panels would be used to form an interior wall and an opposite exterior wall so that concrete is received therebetween. Each wall would have a plurality of panels which are connected top to bottom and side to side.

Figure 30:
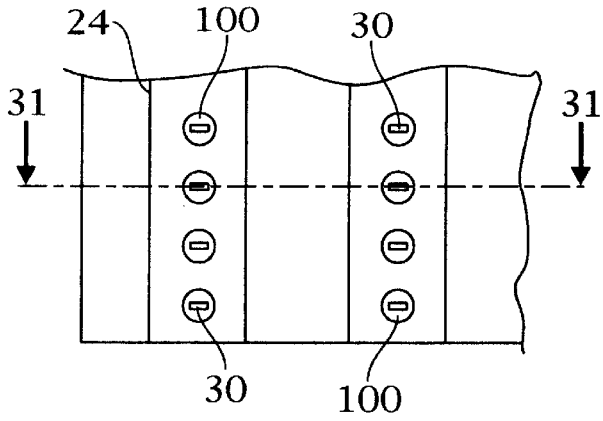
FIG. 30 is a front plan view of an embodiment having a plurality of depressions formed in the studs.
Figure 31:
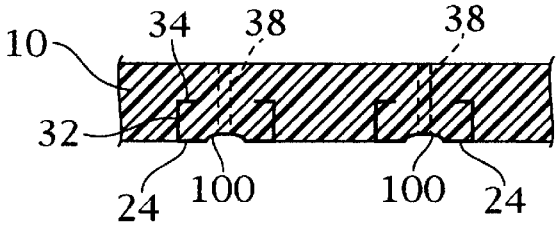
FIG. 31 is a cross-sectional view taken across the lines 31—31 of FIG. 30.
Figure 32:
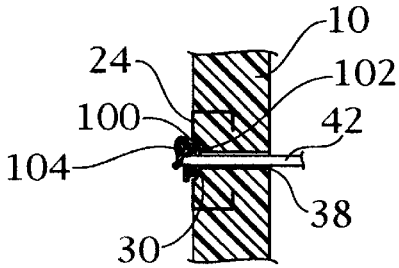
FIG. 32 is a cross-sectional view showing a loop bridge disposed in the panel of FIG. 30.

As previously noted, the studs 24 need not have a depressed center column but may have a plurality of vertically aligned depressions 100 formed therein. As shown in FIGS. 30–32, the studs 24 have a substantially flat column with extension legs 32 and stud locking extensions 34. Each depression 100 has a bridge access opening 30 formed therein. As previously described, the end of a loop bridge 42 may be received in the bridge access opening 30 and secured thereto by means previously described. Alternately, a washer means 102 is disposed over the loop 44 on the loop bridge and a pin or spring clip 104 is disposed in the loop 44 to retain the panel 10. The opposite end of the loop bridge 42 extends from the face of the panel 10 opposite from the stud 24. The loop 44 in the opposite end of the loop bridge 42 receives the arm 94 of the U-shaped bridge 92.

Figure 33:
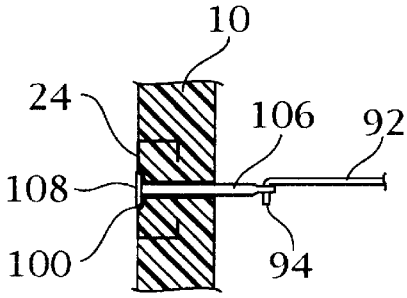
FIG. 33 is a cross-sectional view showing a prong with a head disposed in the panel of FIG. 30.

In an alternate embodiment (FIG. 33), a prong 106 having a nail-like head 108 at one end and a through opening 110 at the end opposite the head 108 is disposed in the bridge access opening 30 in the stud 34. The head 108 is disposed in the depression 100 and the arm 94 of the bridge 92 is received in the through opening 110. A plurality of prongs 106 are disposed in studs 24 in opposing panels 10. The bridge 92 has a desired length which is the thickness of the concrete wall which is formed between the opposing panels 10. The bridges 92 extend between the panels and further serve as reinforcing means for the concrete.

Figure 34:
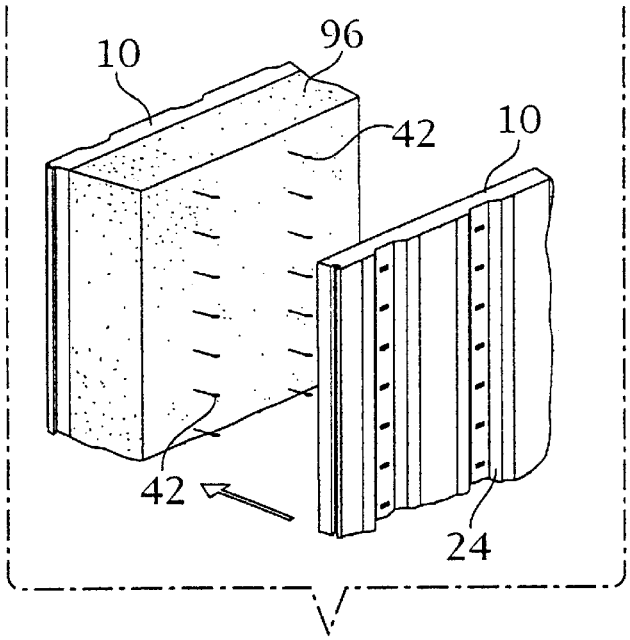
FIG. 34 is a perspective view showing a panel being replaced over the formed concrete wall.
Figure 35:
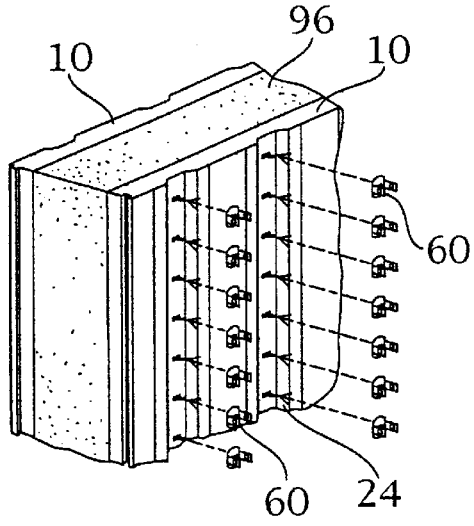
FIG. 35 is a perspective view showing retaining clips being replaced over the panel of FIG. 34.

Referring to FIGS. 34 and 35, the panels 10 which have previously been removed from the concrete wall may be replaced. The extending bridge is not broken off or removed. The panels 10 are replaced on the extending bridges with the ends of the bridges being received in the openings 30 in the studs 24. The retaining means 60 are replaced over the bridges and are secured to hold the panels 10 firmly against the concrete wall 96. This removal and replacement of the panels 10 is to accelerate the curing of the concrete wall after the wall has initially set and is partially cured. Removal of the panels 10 expose the concrete to the environment and allow moisture in the concrete to evaporate more rapidly. If the panels 10 are allowed to remain on the concrete wall, the majority of the moisture evaporates and the concrete is substantially cured in about eight (8) months. However, removal of the panels accelerates the cure time to approximately one (1) month. The removal and replacement of the panels does not produce any substantial changes to the structural integrity, utility or appearance of the overall structure.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, each stud having a first extension leg and a spaced-apart second extension leg, each extension leg being perpendicular to the stud and extending into the respective insulation panel, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels.

2. The assembly of claim 1, wherein the connecting means on the first end of the bridge and the engaging means on the second end of the bridge means is a respective loop, the respective loops being received in a selected opening in a selected stud in the first and second panels, the respective loops extending outwardly from the outer face of the first and second panel.

3. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panel, wherein the engaging means on the second end of the bridge means is a downwardly depending member, the inner face of the second panel having a plurality of connector members disposed thereon, the engaging means on the second end of the bridge being connected to a selected connector member on the inner panel.

4. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein each stud has a first extension leg and a spaced-apart opposite second extension leg, each extension leg being perpendicular to the stud and extending into the respective panel.

5. The assembly of claim 4, wherein each stud is formed from sheet metal having a desired thickness.

6. The assembly of claim 4, wherein each stud has a length from the top to the bottom of the respective panel.

7. The assembly of claim 4, wherein each extension leg has a plurality of spaced-apart perforations formed therein such that when the panel is formed, insulation flows through the perforations, securing the stud within the panel and preventing movement of the stud with respect to the panel.

8. The assembly of claim 4, wherein the first and the second extension leg of each stud, each has a respective stud locking extension thereon formed at right angles to the first extension leg and to the second extension leg and distal from the respective stud.

9. The assembly of claim 4, wherein each stud has a recessed center portion, the vertically spaced-apart openings being formed in the recessed center portion.

10. The assembly of claim 4, wherein each loop bridge is formed from a wire having a desired diameter.

11. The assembly of claim 4, wherein the plurality of retainer means may be removed from each loop bridge such that the panel may be removed from the concrete after the concrete has set.

12. The assembly of claim 4, wherein each panel is formed of expanded polystyrene.

13. The assembly of claim 4, wherein the retainer means is removable.

14. The assembly of claim 4, wherein the retainer means is resilient.

15. The assembly of claim 4, wherein each stud has a plurality of vertically aligned depressions formed therein.

16. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein a key keeper is formed on opposite sides of each opening in each stud, wherein the retainer clip means engage the key keepers on each side of the opening.

17. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein the retainer means is a locking key having a wider base tapering to a narrower locking extension, the base having a locking slot formed at an approximate mid-point of the base such that the locking slot in the base straddles the loop bridge and the locking key is bent through approximately 180° wherein the locking extension is received in the loop in the end of the loop bridge, thereby securing the panel to the loop bridge.

18. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein the retainer means is a rotating retainer having a base and a pair of parallel legs on opposite sides of the base extending perpendicularly from the base, each leg having an opening therein distal from the base, a slot having a center line being formed in the base between the legs, the height of the base between the legs along the center line of the slot being less than the length of the base perpendicular to the center line of the slot, such that the loop on the loop bridge may be received in the slot in the base and the retainer means rotated through 90°, such that the openings in the legs of the rotating retainer are aligned with the loop of the loop bridge, a key keeper being formed on opposite sides of each opening in each stud, such that the base of the rotating retainer engages the key keepers and the rotating retainer is secured therein, a spring key being inserted through the openings in the legs of the rotating retainer and through the loop of the loop bridge thereby securing the panel to the loop bridge.

19. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein the retainer means are tab legs, the stud having a first lanced out portion above and a second lanced out portion below each opening in each stud, the first and the second lanced out portions being folded through approximately 90° outwardly from the stud such that the lanced out portions are approximately parallel to each other and to the loop of the loop bridge, a hole being formed in each of the first lanced out portion and the second lanced out portion, the holes being aligned with each other and with the loop in the loop bridge, a plurality of spring keys, one spring key being disposed respectively through the holes in each of the lanced out portions and through each of the loops in the ioop bridges thereby securing the panel to each loop bridge.

20. A concrete form assembly for construction of structures, the assembly comprising:

at least a first and a second rectangular insulation panel, each panel having an inner face and an outer face, the panels being disposed such that the inner faces of the respective panels are oriented toward one another, a plurality of studs vertically disposed on the outer face of the first panel, the studs being equidistantly spaced apart, a plurality of vertically spaced-apart openings being formed in each stud, a plurality of bridge means, each bridge means having a first end, an opposite second end and a length therebetween, a connecting means formed on each first end and an engaging means being formed on each second end, each bridge means being received in a respective one of the openings in each stud with the connecting means on the first end being exteriorly of the stud, the bridge means extending through the first panel and the engaging means on the second end being connected to the second panel, the bridge means being disposed across a desired space between the first panel and the second panel, concrete being received in the space between the panels, a plurality of retainer means, each end of each loop bridge receiving a respective retainer means thereon wherein the panels are secured in the desired spaced-apart distance to receive concrete therebetween, wherein each loop bridge has two relief notches formed therein, each relief notch being a predetermined distance from the respective opposite ends of the loop bridge, the relief notches facilitating breaking of the loop bridge if desired.

21. A concrete form assembly for construction of structures, the assembly comprising:

at least a first and a second rectangular insulation panel, each panel having respectively a top, a bottom, a first side, an opposite second side, an inner face and an outer face, the panels being disposed opposite to one another wherein the inner faces of the respective panels are oriented toward one another, a plurality of studs vertically disposed on the outer face of the first panel, the studs being equidistantly spaced apart, a plurality of vertically spaced-apart pairs of openings being formed in each stud, one opening of each pair having a greater length than the length of the second opening of said pair, a plurality of bridge clips, each bridge clip having a substantially U-shape with a base and a first and a second parallel leg, the first leg having a greater width than the second leg, each leg having at least one barb formed thereon, each leg further having an aperture formed therein distal from the base of the bridge clip, each bridge clip being disposed in a respective pair of openings in a respective stud, the first wider leg being received in the opening with the greater length and the second leg being received in the second opening, the distal ends of each leg having the openings therein extending beyond the inner face of the insulation panel, wherein the barbs on the legs engage the insulated panel and prevent removal of the bridge clip, a U-shaped wire bridge having an arm at opposite ends thereof, one arm of the wire bridge being received in the apertures in the distal ends of the legs of the bridge clip, the other arm of the wire bridge being connected to the second panel, wherein the panels are spaced apart by the wire bridge and concrete is received in the space between the panels.

22. The assembly of claim 21, wherein the distal aperture in the first leg of the bridge clip is misaligned with the distal aperture in the second leg of the bridge clip such that pressure is applied to the one arm of the wire bridge and the one arm is locked in the bridge clip.

23. The assembly of claim 21, wherein the second leg of the bridge clip is longer than the first leg of the bridge clip.

24. A concrete form assembly for construction of structures, the assembly comprising:

at least a first and a second rectangular insulation panel, each panel having respectively a top, a bottom, a first side, an opposite second side, an inner face and an outer face, the panels being disposed opposite to one another wherein the inner faces of the respective panels are oriented toward one another, a plurality of studs vertically disposed on the outer face of each panel, the studs being equidistantly spaced apart, a plurality of vertically spaced-apart openings being formed in each stud, a plurality of prongs, each having a head at a first end and a through opening formed transversely at an opposite second end, a respective prong being disposed in a respective opening in each stud in each panel, wherein the head of the prong is near the outer face of the panel and the through opening of the prong extends from the inner face of the panel, a plurality of bridges, each bridge being U-shaped having a first end, an opposite second end and a length therebetween, the first end of each bridge being received in a respective through opening in the prong in one of the panels and the second end of each bridge being received in a respective through opening in the prong in the opposite panel, the bridge being disposed across a desired space between the opposite panels, and concrete is received in the space between the opposite panels.

25. A concrete wall for construction of structures, the wall comprising:

at least a first and a second rectangular insulation panel, each panel having an inner face and an outer face, the panels being disposed such that the inner faces of the respective panels are oriented toward one another, a plurality of studs vertically disposed on the outer faces of each of the panels, the studs being equidistantly spaced apart, each stud being embedded in the insulation panel, a plurality of vertically spaced-apart openings being formed in each stud, a plurality of bridge means, each bridge means having a first end, an opposite second end and a length therebetween, the first end of each bridge means being received in a respective opening in the studs in the first panel, the second end of each bridge means being received in a respective opening in the studs in the second panel, the bridge means being disposed across a desired space between the first panel and the second panel, a plurality of retainer means, each end of each bridge means receiving a respective retainer means thereon wherein the panels are secured in the desired spaced-apart disposition, the concrete wall being disposed between the panels, the bridge means serving as reinforcing means for the concrete.

26. A concrete wall for construction of structures, the wall comprising:

a plurality of rectangular insulation panels, each having atop, a bottom a first side, a second side, an inner face and an outer face, the panels being interconnected forming a wall, a plurality of studs vertically disposed on the outer face of each of the panels, the studs being equidistantly spaced, a plurality of bridge means disposed in each stud in each panel extending approximately perpendicularly from the inner face of each panel, the concrete wall being connected to the panel by the bridge means which serve as reinforcing means for the concretes each bridge means having a member extending outwardly from each respective stud, a plurality of removable retainer means, each member of each bridge means receiving a retainer means thereon, wherein, the insulation panel is retained on the concrete wall and the insulation panel may be removed from the concrete wall by removal of the removable retaining means after the concrete has set.

27. The concrete wall of claim 26, wherein each member of each bridge means has formed thereon at least one relief notch, such that each bridge means may be broken off at the respective relief notch after the insulation panel is removed and none of the bridge means extend outwardly from the concrete wall.

* * * * *